United States Patent [19]

White

[11] 4,120,761

[45] Oct. 17, 1978

[54] ELECTROCHEMICAL PROCESS FOR THE PREPARATION OF ACETALS OF 2-HALOALDEHYDES

[75] Inventor: Donald A. White, Creve Coeur, Mo.

[73] Assignee: Monsanto Company, St. Louis, Mo.

[21] Appl. No.: 861,068

[22] Filed: Dec. 15, 1977

[51] Int. Cl.[2] ..... C25B 3/02; C07C 41/10

[52] U.S. Cl. ..... 204/59 R; 204/72; 204/78; 260/615 A

[58] Field of Search ..... 204/59 R; 260/615 A

[56] References Cited

U.S. PATENT DOCUMENTS

| | | | |
|---|---|---|---|
| 3,257,298 | 6/1966 | Hughes | 204/78 |
| 4,046,652 | 9/1977 | Pistorius et al. | 204/78 |

OTHER PUBLICATIONS

Tomilov et al., J. Gen. Chem. USSR (trans Zh Obsh Khimii) vol. 44, No. 9, pt. 2 pp. 1990–1993 9–74.

*Primary Examiner*—F.C. Edmundson

*Attorney, Agent, or Firm*—Wendell W. Brooks; Joseph D. Kennedy; James W. Williams, Jr.

[57] ABSTRACT

Electrolysis of a substantially anhydrous electrolysis medium comprising a primary alcohol having at least one beta-hydrogen atom and anhydrous hydrogen halide selected from the group consisting of hydrogen chloride and hydrogen bromide yields acetals of 2-haloaldehydes corresponding to the primary alcohol.

16 Claims, No Drawings

ELECTROCHEMICAL PROCESS FOR THE PREPARATION OF ACETALS OF 2-HALOALDEHYDES

BACKGROUND OF THE INVENTION

This invention relates to a process for the preparation of acetals of 2-haloaldehydes, or 2-haloaldehyde acetals or simply 2-haloacetals, by subjecting primary alcohols having at least one beta-hydrogen atom to electrolysis under substantially anhydrous conditions in the presence of anhydrous hydrogen halide selected from the group consisting of hydrogen chloride and hydrogen bromide in an electrolytic cell. Exemplary of the 2-haloaldehyde acetals is chloroacetal (chloroacetaldehyde diethyl acetal) prepared from absolute ethanol and anhydrous hydrogen chloride. The products are useful as versatile bifunctional reagents. They can react either as alkyl halides or as sources of the aldehyde functionality, or both.

The preparation of acetals of 2-haloaldehydes, particularly acetals of 2-chloroaldehydes has been previously described in the prior art. Bievre et al, *Bulletin des Societes Chimiques Belges,* 68, 550–557 (1959) describes the preparation of chloroacetaldehyde diethyl acetal by treating ethyl alcohol with chlorine gas. Chattaway et al, *Journal of the Chemical Society,* 125, 1097–1101 (1924); Fritsch, *Annalen,* 279, 288–300 (1894); and Lieben, *Annalen,* 104, 114–115 (1857) describes similar procedures. Overall, the reaction proceeds according to diagrammatically simplified reaction (1).

$$3CH_3CH_2OH + 2Cl_2 \rightarrow ClCH_2CH(OCH_2CH_3)_2 + 3HCl + H_2O \quad (1)$$

However, chemical routes involving these raw materials suffer from the disadvantage that the reaction produces three moles of hydrogen chloride per mole of acetal. The disposal of this large volume of hydrogen chloride presents obvious difficulties which significantly detract from the attractiveness of such chemical processes for large scale reactions.

It has now been discovered tha the difficulties and disadvantages associated with the prior art chemical processes are overcome by the process of the present invention which represents a substantial improvement in the sense that (a) hydrogen halide is consumed during the reaction, thereby alleviating the problem of disposal of large volumes of hydrogen halide; and (b) only innocuous co-products--hydrogen, which may be burned to water, and water itself--are produced during the reaction.

Various other advantages of this invention will become apparent from the accompanying description and claims.

SUMMARY OF THE INVENTION

This invention involves a process for the preparation of acetals of 2-haloaldehydes. The process comprises subjecting a substantially anhydrous liquid electrolysis medium comprising a primary alcohol having at least one beta-hydrogen atom and anhydrous hydrogen halide selected from the group consisting of hydrogen chloride and hydrogen bromide to electrolysis in an electrolytic cell to yield the acetal of the 2-haloaldehyde corresponding to the primary alcohol.

The 2-haloaldehyde acetal products obtained in the present process are easily recovered by neutralizing unreacted hydrogen halide with calcium carbonate and removing the excess primary alcohol and/or added solvent (when employed). The product can be purified, if desired by distillation at appropriate temperatures and pressures.

DETAILED DESCRIPTION OF THE INVENTION

The electrochemical preparation of acetals of 2-haloaldehydes of the present process is conveniently represented by reactions (2) through (6) wherein $R^1$ and $R^2$ are individually selected from hydrogen, alkyl, and phenyl; $R^3$ represents a hydrocarbyl moiety corresponding to the primary alcohol undergoing conversion, $R^1R^2CHCH_2$—, or methyl; and X represents a halogen selected from the group consisting of chlorine and bromine.

$$\text{ANODE REACTION } 4X^{31} \rightarrow 2X_2 + 4e^- \quad (2)$$

$$\text{SOLUTION REACTION } X_2 + R^1R^2CHCH_2OH \rightarrow R^1R^2CHCHO + 2H^+ + 2X^- \quad (3)$$

$$R^1R^2CHCHO + 2R^3OH \rightleftarrows R^1R^2CHCH(OR^3)_2 + H_2O \quad (4)$$

$$R^1R^2CHCH(OR^3)_2 + X_2 \longrightarrow R^1R^2\underset{\underset{X}{|}}{C}CH(OR^3)_2 + H^+ + X^- \quad (5)$$

$$\text{CATHODE REACTION } 4H^+ + 4e^- \rightarrow 2H_2 \quad (6)$$

The net effect of reactions (2) through (6) are summarized as shown in reaction (7).

$$R^1R^2CHCH_2OH + 2R^3OH + HX \longrightarrow R^1R^2\underset{\underset{X}{|}}{C}CH(OR^3)_2 + 2H_2 + H_2O \quad (7)$$

While not desiring to be bound by the theory of the present invention, it is believed that the present invention, as illustrated by reactions (2) through (6), comprises (a) anodic generation of molecular halogen from the halide ion provided by the anhydrous hydrogen halide;

(b) oxidative reaction of the molecular halogen with the primary alcohol to form the corresponding aldehyde;

(c) acid-catalyzed conversion of the aldehyde to the acetal; and (d) halogenation of the acetal to form the 2-haloaldehyde acetal product.

Cathodic reduction of hydrogen ions (protons) completes the electrochemical reaction.

In accordance with the process of the present invention, the electrochemical preparation of acetals of 2-haloaldehydes is carried out by subjecting a substantially anhydrous liquid electrolysis medium comprising a primary alcohol having at least one beta-hydrogen atom and anhydrous hydrogen halide selected from the group consisting of hydrogen chloride and hydrogen bromide to electrolysis in an electrolytic cell to yield the acetal of the 2-haloaldehyde corresponding to the primary alcohol.

The term "substantially anhydrous" is employed herein to indicate the presence of only nominal amounts of water. It will be noted that while the presence of water in the electrolysis medium on the order of about 5 percent by weight may be tolerated, the maximum water content is preferably no more than about 1 percent to about 2 percent by weight, with even lower values being most preferred.

The primary alcohols of most interest for use in the present process include those up to $C_{20}$, although any primary alcohol having at least one beta-hydrogen atom may be used, if desired. It will be noted, however, that the higher molecular weight alcohols for example, greater than $C_6$, will generally require added solvent (other than excess substrate primary alcohol) as discussed hereinbelow.

Exemplary of the primary alcohols suitable for use in the present process are ethanol, 1-propanol (n-propyl alcohol), 1-butanol (n-butyl alcohol), 2-methyl-1-propanol (isobutyl alcohol), 3-methyl-1-butanol, 3,5-dimethyl-1-hexanol, 5,5-dimethyl-1-hexanol, 2-phenylethanol, 2,2-diphenylethanol, and the like.

The present reaction can be effected in the presence of an added solvent (other than excess substrate primary alcohol) for the primary alcohol and the anhydrous hydrogen halide. This, of course, permits the employment of high molecular weight alcohols, for example, greater than $C_6$, which have low dielectric constants and, in particular, may be solids at appropriate reaction temperatures.

Suitable added solvents which can be employed are preferably relatively inert under reaction conditions. By "relatively inert," it is meant that the added solvents, under process conditions, (a) do not preferentially undergo electrochemical reaction and (b) do not significantly react with the anhydrous hydrogen halide.

The latter requirement [(b)] is especially significant in that several of the usual electrochemical solvents—amines, ethers, cyclic carbonates, for example—react with anhydrous hydrogen halide, and therefore are not suitable. Even acetonitrile and dimethylformamide, perhaps the most common aprotic electrochemical solvents, react with the hydrogen halide and alcohol solution. Therefore, as a practical matter, neither acetonitrile nor dimethylformamide is preferred. Methylene chloride, however, is suitable and gives results comparable with those obtained when using excess primary alcohol as solvent. (Compare Examples 3 and 12, Table 1.) And although its volatility is an added advantage during work-up of the reaction solution, its low dielectric constant is slightly disadvantageous.

Another solvent which surprisingly is also suitable for use is methanol. It has a high dielectric constant (32.63 at 25° C.); is oxidized only with difficulty by anodically generated halogen (see Example 14, Table 1); has no beta hydrogen atoms; and is reasonably volatile. It will be recognized, however, that when methanol is employed (in excess) as the added solvent, the acetals of the 2-haloaldehydes will be dimethyl acetals. This fact presents no difficulty, however, since one acetal moiety is essentially eqivalent to another acetal moiety as a source of an aldehyde functionality. Indeed, methanol is a particularly advantageous solvent when the substrate primary alcohol is a high molecular weight alcohol.

The reactions which occur when methanol is employed as the added solvent can be illustrated by reactions (8) through (10) using hydrogen chloride as the hydrogen halide.

$$R^1R^2CHCH_2OH + 2CH_3OH + HCl \longrightarrow R^1R^2\underset{\underset{Cl}{|}}{C}CH(OCH_3)_2 + 2H_2 + H_2O \quad (8)$$

$$R^1R^2CCH(OCH_2CHR^1R^2)_2 + CH_3OH \rightleftharpoons R^1R^2\underset{\underset{Cl}{|}}{C}CH(OCH_2CHR^1R^2)OCH_3 + R^1R^2CHCH_2OH \quad (9)$$

$$R^1R^2CCH(OCH_2CHR^1R^2)OCH_3 + CH_3OH \rightleftharpoons R^1R^2\underset{\underset{Cl}{|}}{C}CH(OCH_3)_2 + R^1R^2CHCH_2OH \quad (10)$$

It will be apparent of course that when $R^3$ represents methyl and X represents chlorine, reaction (8) is equivalent to reaction (7).

As illustrated in reaction (8), the formation of the dimethyl acetal depends primarily on the use of a large excess of methanol, although the acid-catalyzed equilibrium between the three possible acetals as illustrated in reactions (9) and (10) is also important. The latter equilibrium reactions are important because consumption of the substrate primary alcohol displaces these equilibria to the right (to ultimately produce the dimethyl acetal) as the reaction progresses.

From the discussion hereinabove, it is apparent that when an added solvent is desired and when the dimethyl acetal product is suitable, methanol is the solvent of choice.

Added primary alcohol (other than the substrate primary alcohol and methanol) may be suitable for use as added solvent,—that is, mixtures of primary alcohols—however, such mixtures of primary alcohols would give difficult to separate mixtures of products. Therefore, as a practical matter, such mixtures of primary alcohols are to be avoided.

The anhydrous hydrogen halides suitable for use in the present process are selected from the group consisting of hydrogen chloride and hydrogen bromide. Of these, hydrogen chloride is preferred because of the greater chemical reactivity of chlorine with the substrate primary alcohol. This greater chemical reactivity prevents accumulation of molecular chlorine in the liquid electrolysis medium, and thereby minimizes useless reduction to chloride ions at the cathode. This useless oxidation-reduction equilibrium, when encountered, results in a decrease in current efficiency. Iodine, of course, has a very great tendency to undergo this oxidation-reduction equilibrium. Indeed hydrogen iodide is generally not suitable for use in the present process in that when it is employed as the hydrogen halide the reaction fails to yield the desired acetal of the 2-iodoaldehyde corresponding to the primary alcohol.

Bromine, as expected, is intermediate between chlorine and iodine in its tendency to undergo an oxidation-reduction equilibrium. Hydrogen bromide is also somewhat more expensive than is hydrogen chloride. However, when hydrogen bromide is employed as the hydrogen halide, the reaction proceeds in a very satisfactory manner to yield the acetal of the 2-bromoaldehyde corresponding to the primary alcohol. Accordingly, hydrogen bromide, while less preferred than hydrogen chloride is quite suitable for use as the hydrogen halide.

As will be apparent, when the reaction is carried out in the absence of added solvent, the concentration of the primary alcohol is of no consequence. And even when an added solvent is used, the concentration is not critical and can vary within fairly wide limits. When methylene chloride is the added solvent, a convenient concentration range is between about 5 percent up to about 25 percent or more by weight of the electrolysis medium, or on a molar basis, between about 1.0 molar and about 6.0 molar. As noted, however, the concentration is not critical and any convenient concentration can be used so long as sufficient current can pass to permit the reaction to proceed at a reasonable rate.

When methanol is employed as the added solvent, the concentration becomes slightly more critical in that, as noted hereinabove, formation of the dimethyl acetal depends primarily on the presence of a large excess of methanol. The molar ratio of methanol to primary alcohol must be at least 2:1 as shown in reaction (8). A molar ratio range between about 4:1 and about 24:1 is preferred, however, with a ratio of about 8:1 being most preferred. And while the upper limit (24:1) is not critical, for reasons of practicality higher ratios, which would produce extremely dilute reaction solutions (and likely require larger amounts of hydrogen halide) and thereby make isolation of the 2-haloaldehyde acetal product more tedious and time-consuming, are not generally employed.

Expressed on a molar basis, a suitable and convenient concentration range is between about 1.0 molar and about 6.0 molar, with about 3.0 molar being generally preferred when methanol is employed as the added solvent.

Thus, when an added solvent is employed, a molar concentration of the substrate primary alcohol in the added solvent of about 1.0 molar to about 6.0 molar is generally preferred.

The concentration of the hydrogen halide is not narrowly critical, although, as noted hereinabove, low concentrations [particularly in conjunction with low temperatures (<30° C.)] tend to favor production (albeit in only minor amounts) of unsubstituted (nonhalogenated) acetal. A suitable molar ratio of hydrogen halide to the substrate primary alcohol is between about 1:0.1 and about 1:10. The higher molar ratio (1:0.1) limit, however, is imposed more for practical reasons than for criticality of process conditions in that isolation of the product requires neutralization of unreacted hydrogen halide. A convenient range, therefore, is between about 1:0.5 and about 1:5. It will be recognized, however, that if it is desired to reduce to a minimum the amount of unreacted hydrogen halide requiring neutralization upon completion of the reaction, hydrogen halide concentrations toward the lower molar ratio limit may be preferred.

In any event, the concentration of the anhydrous hydrogen halide need only be sufficient to permit the desired production of the 2-haloaldehyde acetal product to proceed at a reasonable rate.

The electrolysis of the present process can be conducted at a broad range of temperatures—ambient, or higher or lower temperatures—although as noted hereinabove, temperatures of less than 30° C. tend to favor production of unsubstituted acetal product (albeit in minor amounts). For convenience, temperature ranges from about 0° C. and about 100° C. are suitable, with the range between about 30° C. and about 75° C. being preferred.

If volatile material—low molecular weight primary alcohols ($C_2$–$C_4$) and added solvents of methylene chloride or methanol—are employed, it may be desirable to avoid elevated temperatures greater than the preferred higher temperature so that these materials will not escape. Various cooling means can be used for this purpose. The amount of cooling capacity needed for the desired degree of control will depend upon the cell resistance and the electrical current drawn. If desired, cooling can be effected by permitting a component to reflux through a cooling condenser, or by immersing the electrolytic cell in a cold water bath, or an ice or ice-salt bath. Pressure can be employed to permit electrolysis at higher temperatures with volatile components, but unnecessary employment of pressure is usually undesirable from an economic standpoint.

The process of the present invention can be conducted at atmospheric pressure, super atmospheric pressures, and subatmospheric pressures. For reasons of economy and ease of construction of the equipment employed in the present process it is preferred to conduct this process at atmospheric pressure. As noted hereinabove, however, pressure (super atmospheric pressures) can be employed to permit electrolysis at higher temperatures with volatile components.

Various current densities can be employed in the present process. It will be desirable to employ high current densities in order to achieve high use of electrolytic cell capacity which will result in increased payload. Therefore, for production purposes it will generally be desirable to use as high a density as feasible, taking into consideration sources and cost of electrical current, resistance of the electrolysis medium, heat dissipation, effect upon yields, and the like. Over broad range of current density, the density will not greatly affect yield. And while low densities are operable, suitable ranges for efficient operation will generally be in the range of a few hundred amperes per square meter of anode surface up to 10,000 or more amperes per square meter.

In effecting the present process, the cell voltage must be sufficient to pass the desired current (amperes) and to effect anodic oxidation of the hydrogen halide. It will be recognized, however, that the cell voltage will vary with electrode materials and their surface condition, the distance between the electrodes, various materials in the electrolysis medium, resistance of the electrolysis medium, and the like. For example, under the conditions employed in the illustrative Examples described hereinbelow, the cell voltage ranges between about +4.0 volts and about +36 volts.

The present process can be conducted in the various types of electrolytic cells known in the art. In general, such cells comprise a container made of material capable of resisting action of electrolytes, that is, material which is inert under the reaction conditions, for example, glass or plastic, and one or more anodes and cathodes connected to a source of direct electric current such as a battery and the like. The anode may be of any electrode material so long as it is relatively inert under the reaction conditions. Suitable anode materials include, for example, graphite, de Nora-type dimensionally stable anodes, the precious metals such as platinum, palladium, ruthenium, rhodium, and the like, and the precious metals plated onto other metals, such as, for example, titanium and tantulum. The precious metal type anodes, however, suffer from the disadvantages of being relatively expensive and somewhat susceptible to corrosion under reaction conditions.

The de Nora-type dimensionally stable anodes employ precious metal oxides plated on a titanium substrate. Other materials include, for example, ruthenium oxide, mixed with oxides of titanium and tantalum, also plated on a titanium substrate. Dimensionally stable anodes suitable for use in the present process are currently commercially available from the Diamond Shamrock Company, Cleveland, Ohio 44114.

The anode materials of choice are graphite and de Nora-type dimensionally stable anodes, with graphite generally being preferred. It will be recognized, however, that it may be advantageous to employ de Nora-type anodes under long-term conditions where anode corrosion may occur. A further advantage resulting from the use of dimensionally stable anodes is the lowering of the halogen overvoltage with a concurrent lowering of energy requirements.

Any suitable electrode material may be employed as the cathode so long as it is relatively inert under the reaction conditions and does not promote the production of undesirable by-products. Graphite serves admirably as the cathode material of choice. Low hydrogen overvoltage metals, such as, for example, platinum, palladium, and the like are also suitable as cathode materials, although, as noted hereinabove, they suffer from the disadvantage of being relatively expensive.

In the present process, either an undivided or a divided cell can be employed. An undivided cell, however, is generally preferred in that electrical resistance across a cell divider is eliminated. This, of course, could have advantages for industrial production.

A divided cell contains a suitable barrier material or separator which will prevent the free flow of reactants between the cathode and the anode. Generally, the separator is some mechanical barrier which is relatively inert to electrolyte material, for example, a fritted glass filter, glass cloth, asbestos, and the like but will permit the passage of current to complete the electrical circuit.

When a divided cell is used, it will be possible to employ the same electrolysis medium on both the anode and cathode sides, or to employ different media. Ordinarily, it will be desirable to employ the same medium on both the anode and cathode sides; however, in some circumstances, it may be desirable to employ a different catholyte for economy of materials, lower electrical resistance, and the like.

As noted hereinabove, however, an undivided cell is preferred for use in the present process.

The electrolytic cells employed in the illustrative Examples herein are primarily for laboratory demonstration purposes. Production cells are usually designed with a view to the economics of the process, and characteristically have large electrode surfaces and short distances between the electrodes.

For a general description of various laboratory scale cells, see Lund et al, "Practical Problems in Electrolysis," in *Organic Electrochemistry* (Baizer, ed.), Marcel Dekker, New York, 1973, pp. 165–249, and for some considerations of industrial cell designs, see Danly, "Industrial Electroorganic Chemistry," in Ibid., pp. 907–946.

The 2-haloaldehyde acetal products obtained in the present process are isolated by neutralization of the reaction mixture with excess calcium carbonate (alkali metal carbonates, for example, sodium carbonate, may also be used, but are less effective in that they become coated with alkali metal halide), filtration, and atmospheric-pressure distillation of the unreacted primary alcohol and/or added solvent to give a mixture of the crude product and calcium halide. This mixture is partitioned between water and a suitable water immiscible organic solvent, for example, diethyl ether and the organic solvent separated, washed with water, dried over an appropriate dessicant, for example, anhydrous calcium sulfate, filtered, and evaporated to give the crude product. The crude product is distilled at appropriate temperatures and pressures to yield the pure acetal of the 2-haloaldehyde.

Varying amounts of by-products are produced during the present process in addition to the desired 2-haloaldehyde acetal product. These by-products include the unsubstituted (non-halogenated) acetal, the dihaloacetal (for primary alcohols having two or three beta hydrogen atoms), and the trihaloacetal (from ethanol which has three beta hydrogen atoms). The relative importance of these by-products depends, as noted hereinabove, on reaction temperature, hydrogen halide concentration, and, in addition, substrate primary alcohol conversion. Since low temperature, as well as low hydrogen halide concentrations, favor production of the unsubstituted acetal, the process is generally carried out at the preferred temperature ranges and within the preferred hydrogen halide to primary alcohol molar ratio ranges.

As noted hereinabove, however, if it is desired to reduce to a minimum the amount of unreacted hydrogen halide to be neutralized following completion of the reaction, it is possible to use a low hydrogen halide concentration and pass sufficient current to consume almost all of it. The most abundant by-product under these conditions, the unsubstituted acetal, may be recycled with the unreacted primary alcohol and/or added solvent for further reaction.

The effect of conversion on the production of by-products is more complex than the temperature and hydrogen halide concentration factors. As the conversion increases, selectivity to the monohaloacetal product decreases—albeit to a constant value which is quite high (Examples 5–8, Table 1)—due to increased dihaloacetal formation (Examples 3–5, Table 1). However, while the selectivity reaches a constant value, there is a progressive decline in current efficiency (Examples 3–8, Table 1). As a result, it is generally desirable to use fairly low conversions.

The term "selectivity" is employed herein to mean the amount of monohaloaldehyde acetal product expressed as a percentage of the total moles of all acetal products.

Other minor by-products include the corresponding ester, for example, ethyl acetate from ethanol and n-butyl butyrate from n-butyl alcohol. This becomes the major product when substantial amounts of water are present in the electrolysis medium, for example, when concentrated aqueous hydrogen halide is substituted for the anhydrous hydrogen halide. For this reason, the presence of water in greater than nominal amounts is to be avoided and a substantially anhydrous electrolysis medium is employed.

The following examples illustrate the process of the present invention. They are not to be construed as limitative upon the overall scope thereof.

EXAMPLE 1

A 1-liter, 3-necked, round-bottomed flask equipped with a magnetic stirrer; two graphite-rod electrodes (12 inches × 0.25 inch diameter; 30.48 centimeters × 0.635 centimeter diameter) inserted, via two 10/18 standard taper joint Teflon thermometer adaptors, into a glass electrode adaptor having two 10/18 standard taper joints and one 34/50 standard taper joint; a water-cooled reflux condenser, topped with a liquid paraffin bubbler in one 24/40 standard taper joint side neck; and a 10/18 standard taper joint thermometer placed in the remaining side neck via a 10/18-24/40 glass adaptor so as to extend into the electrolysis medium was used as an electrolytic cell. The graphite-rod electrodes were adjusted until they projected as far into the flask as possible, without interfering with the operation of the magnetic stirring bar.

Absolute ethanol (230.0 grams, 5.00 moles) and 38.0 grams (1.04 moles) of hydrogen chloride (via an immersed glass frit-tipped gas bubbler which was subsequently removed and replaced by the thermometer) were charged to the electrolytic cell which was thereafter partially immersed in a bath of flowing cold water. The resultant solution was electrolyzed at a constant current of 1.5 amperes for 18 hours (which is equivalent to 27.0 ampere-hours which equal 1.01 faradays). The cell voltage was initially 4.0 volts and rose slowly to 4.5 volts. The temperature of the electrolyte solution was 30°-32° C. A small portion (about 1 percent by weight) of the electrolyzed solution was withdrawn and analyzed by nuclear magnetic resonance spectroscopy. By integration of the triplet acetal proton resonance [$ClCH_2CH(OCH_2CH_3)_2$] and the triplet resonance of a known added quantity of 1,1,2-trichloroethane, it was determined that 0.20 mole of chloroacetal had been formed.

The electrolyzed solution was neutralized by stirring with excess calcium carbonate. The neutralized solution was filtered and the solid residue washed with ethanol. The combined filtrate and washings were distilled to remove most of the ethanol (boiling point 77°-79° C.). The residue was cooled and partitioned between diethyl ether and water. The ether solution was washed with water and dried over anhydrous calcium sulfate. The filtered ether solution was distilled, collecting the fraction with boiling point 156°-160° C., which was identified as chloroacetal (24.1 grams; 0.16 mole; 63 percent efficiency).

The product was identified by comparison with an authentic sample and by its reaction with 2,4-dinitrophenylhydrazine dissolved in concentrated hydrochloric acid which afforded chloracetaldehyde 2,4-dinitrophenylhydrazone, melting point 158°-159° C. (literature melting point 158° C.).

EXAMPLE 2

The electrolytic cell described in EXAMPLE 1 was employed. A solution of 20.0 grams (0.55 mole) of anhydrous hydrogen chloride in 296 grams (4.00 mole) of anhydrous n-butyl alcohol was charged to the cell and electrolyzed with a current of 1.0 ampere for 13.4 hours (which is equivalent to 13.4 ampere-hours which equal 0.50 faraday) following the procedure of EXAMPLE 1. The initial and final cell voltages and temperatures were 18 volts and 27 volts and 30° C. and 32° C., respectively. Work up of the electrolyzed solution afforded 28.5 grams of a colorless oil which was distilled in vacuo to give two fractions: (1) a water-white liquid (12.0 grams), boiling point 65°-70° C./0.05 millimeter of mercury and (2) a water-white liquid (13.5 grams), boiling point 72°-73° C./0.04 millimeter of mercury. The latter fraction [fraction (2)] was identified as 2-chloro-n-butyraldehyde di-n-butyl acetal. Elemental analysis indicated carbon and hydrogen contents of 60.90 and 10.90 percent, respectively, as compared with the theoretical contents of 60.89 and 10.57 percent calculated for 2-chloro-n-butyraldehyde di-n-butyl acetal ($C_{12}H_{25}ClO_2$). The first fraction was also 2-chloro-n-butyraldehyde di-n-butyl acetal contaminated with about 10 mole percent of n-butyraldehyde di-n-butyl acetal as estimated by nuclear magnetic resonance spectroscopy.

The current efficiency for total isolated 2-chloro-n-butyraldehyde di-n-butyl acetal was estimated at 82 percent.

EXAMPLE 3

The electrolytic cell and procedure described in EXAMPLE 2 was employed using 40.0 grams (1.10 moles) of anhydrous hydrogen chloride. The solution was electrolyzed with a current of 1.5 amperes at a temperature of 35°-40° C. until 0.40 faraday had passed. Isolation of the product yielded 19.6 grams (0.083 mole; 83 percent current efficiency; 95 percent selectivity) of 2-chloro-n-butyraldehyde di-n-butyl acetal and 1.1 grams (0.004 mole; 6 percent current efficiency) of 2,2-dichloro-n-butyraldehyde di-n-butyl acetal. A trace of n-butyraldehyde di-n-butyl acetal was also detected.

EXAMPLES 4-8

The electrolytic cell and procedure described in EXAMPLE 3 above was employed except that electric current (1.5 amperes) was passed for incrementally longer periods of time to pass 0.80, 1.20, 1.68, 2.00, and 2.36 faradays, respectively, for EXAMPLES 4, 5, 6, 7 and 8. The results are tabulated in TABLE 1.

EXAMPLE 9

The electrolytic cell and procedure described in EXAMPLE 3 was repeated using 75.2 grams (2.06 moles) of anhydrous hydrogen chloride. The reaction temperature was 35°-36° C. The results are tabulated in TABLE 1.

EXAMPLE 10

The electrolytic cell described in EXAMPLE 1 was charged with 296.0 grams (4.00 mole) of anhydrous n-butyl alcohol and 40.0 grams (0.50 mole) of anhydrous hydrogen bromide. The resultant solution was electrolyzed at a constant current of 1.0 ampere for 26.8 hours (which is equivalent to 26.8 ampere-hours which equal 1.0 faraday). After a brief initial period, the temperature of the electrolyte solution reached 58° C. and thereafter increased only slowly to reach 60° C. at the end of the electrolysis period. Throughout this period the color of bromine persisted in the solution. The electrolyzed solution was allowed to cool to ambient temperatures (during which time the color of bromine disappeared) and treated as described in EXAMPLE 1, giving 23.8 grams of a yellow oil. Distillation at 0.01 millimeter of mercury pressure gave 14.9 grams of 2-bromo-n-butyraldehyde di-n-butyl acetal, boiling point 67°-69° C.; 2.2 grams of a mixed fraction, boiling point 69°-83° C.; and 3.7 grams of 2,2-dibromo-n-butyraldehyde di-n-butyl acetal, boiling point 83°-87° C.

The current efficiencies for the total yield of 2-bromo-n-butyraldehyde di-n-butyl acetal and 2,2-dibromo-n-butyraldehyde di-n-butyl acetal were 23 percent and 8 percent, respectively.

EXAMPLE 11

The electrolytic cell and procedure described in EXAMPLE 10 was employed except that instead of hydrogen bromide, 64.0 grams (0.50 mole) of anhydrous hydrogen iodide was employed. No identifiable products were obtained.

EXAMPLE 12

A solution of 74.0 grams (1.00 mole) of anhydrous n-butyl alcohol in 200 milliliters of methylene chloride was charged to the electrolytic cell described in EXAMPLE 1 and saturated with anhydrous hydrogen chloride. The solution was electrolyzed at a constant current of 0.8 ampere for 3.33 hours (which is equivalent to 2.7 ampere-hours which equal 0.1 faraday) with a cell voltage of 32–36 volts while maintaining a slow stream of anhydrous hydrogen chloride therethrough. The passage of current maintained the solution at reflux. The electrolyzed solution was neutralized by stirring overnight (approximately 16 hours) with excess calcium carbonate. The neutralized solution was filtered and the methylene chloride removed by evaporation. The liquid residue was analyzed by gas-liquid chromatography which showed the presence of 2-chloro-n-butyraldehyde di-n-butyl acetal (4.7 grams; 0.020 mole 80 percent current efficiency) and 2,2-dichloro-n-butyraldehyde di-n-butyl acetal (0.071 gram; 0.00030 mole; 2 percent current efficiency).

EXAMPLE 13

A solution of 74.0 grams (1.00 mole) of anhydrous isobutyl alcohol and 86.0 grams (2.08 moles) of anhydrous hydrogen chloride in 256.0 grams (8.0 moles) of absolute methanol was charged to the electrolytic cell described in EXAMPLE 1 and electrolyzed at a constant current of 4.0 amperes for 26.8 hours (which is equivalent to 107.2 ampere-hours which equal 4.00 faradays). The solution was clear and colorless throughout the electrolysis period. The temperature of the electrolyte solution was 35°–40° C. and the cell voltage 14–17 volts.

The electrolyzed solution was neutralized by stirring with excess calcium carbonate. The neutralized solution was filtered and the solid residue washed with methanol. A portion (1 percent by weight) of the combined filtrate and washings was reserved for gas-liquid chromatographic analysis. The remainder was evaporated to remove the methanol. The residue was partitioned between diethyl ether and water. The ether layer was separated, washed with water, dried over anhydrous calcium sulfate, filtered, and evaporated. The residue was distilled, collecting the fraction with boiling point 144°–149° C. This material was identified by nuclear magnetic resonance spectroscopy as 2-chloroisobutyraldehyde dimethyl acetal (63.0 grams; 0.41 mole; 45 percent current efficiency) by its nuclear magnetic resonance spectrum in deuterochloroform solution (singlet resonances at 1.50, 3.53 and 4.13 parts per million downfield from an internal tetramethylsilane reference, due to the C-methyls, O-methyls and acetal proton, respectively).

As a further confirmation of the identity of the isolated product, a small portion was reacted with 2,4-dinitrophenylhydrazine dissolved in concentrated hydrochloric acid to afford 2-chloroisobutyraldehyde 2,4-dinitrophenylhydrazone. Elemental analysis indicated carbon, hydrogen, chlorine, and nitrogen contents of 42.30, 4.40, 12.20, and 19.90 percent, respectively, as compared with the theoretical contents of 41.88, 3.84, 12.39, and 19.55 percent calculated for 2-chloroisobutyraldehyde 2,4-dinitrophenylhydrazone ($C_{10}H_{11}ClN_4O_4$).

The isolated product was redistilled, taking a center cut with boiling point 145°–146° C. Using this material as a standard for gas-liquid chromatographic analysis, it was determined that the total amount of 2-chloroisobutyraldehyde dimethyl acetal formed was 0.61 mole (61 percent current efficiency) by analysis of the reserved sample of the neutralized reaction mixture.

EXAMPLE 14

The electrolytic cell described in EXAMPLE 1 was employed. A solution of 35.8 (0.98 mole) of anhydrous hydrogen chloride in 256.0 grams (8.00 moles) of absolute methanol was charged to the cell and electrolyzed with a constant current of 4.0 amperes for 10.75 hours (which is equivalent to 43.0 ampere-hours which equal 1.60 faradays). During the electrolysis the temperature of the solution was maintained at 28° C. by water cooling and the cell voltage was constant at 12 volts. Throughout most of the electrolysis period the green color of anodically generated chlorine was evident in the solution.

The electrolyzed solution was examined by nuclear magnetic resonance spectroscopy which showed the presence of methyl formate [$HCOOCH_3$ resonance at 4.70 parts per million downfield from $CH_3OH$ resonance, $HCOOCH_3$ resonance at 0.35 parts per million downfield from $CH_3OH$ resonance] and methylal [$CH_2(OCH_3)_2$ resonance 1.17 parts per million downfield from $CH_3OH$ resonance]. The solution was neutralized with excess calcium carbonate, filtered, and analyzed by gas-liquid chromatography. Methyl formate (2.4 grams; 0.040 mole; 5 percent current efficiency) and methylal (1.4 grams; 0.019 mole; 4.8 percent current efficiency) were shown to be present.

The parameters and results for EXAMPLES 1–14 are summarized and tabulated in TABLE 1. It will be noted that EXAMPLE 14 is included to demonstrate the resistance of methanol to oxidation under process conditions.

TABLE 1

The Formation of Acetals via Electrolysis of Anhydrous Alcohols in the Presence of Anhydrous Hydrogen Halides.

| Ex. | Alcohol | (moles) | Solvent[a] | Halide | (moles) | Current (A) | Temp. (° C) | Electricity Passed (F) | [mmoles (current efficiency)] Unsubs | Monohalo | Dihalo | Selectivity to Mono[b] (%) |
|---|---|---|---|---|---|---|---|---|---|---|---|---|
| 1. | $C_2H_5OH$ | (5.00) | | HCl | (1.04) | 2.0 | 32–3 | 1.00 | 4 (1) | 201 (80) | 7 (4) | 95 |
| 2. | n-$C_4H_9OH$ | (4.00) | | HCl | (0.55) | 1.0 | 30–2 | 0.50 | 6 (2) | 103 (82) | trace | 95 |
| 3. | n-$C_4H_9OH$ | (4.00) | | HCl | (1.10) | 1.5 | 35–40 | 0.40 | trace | 83 (83) | 4 (6) | 95 |
| 4. | n-$C_4H_9OH$ | (4.00) | | HCl | (1.10) | 1.5 | 35–40 | 0.80 | trace | 154 (77) | 15 (11) | 91 |
| 5. | n-$C_4H_9OH$ | (4.00) | | HCl | (1.10) | 1.5 | 35–40 | 1.20 | trace | 204 (68) | 31 (16) | 84 |
| 6. | n-$C_4H_9OH$ | (4.00) | | HCl | (1.10) | 1.5 | 35–40 | 1.68 | trace | 268 (64 | 44 (16) | 86 |

TABLE 1-continued

The Formation of Acetals via Electrolysis of Anhydrous Alcohols in the Presence of Anhydrous Hydrogen Halides.

| Ex. | Alcohol | (moles) | Solvent[a] | Halide | (moles) | Current (A) | Temp. (° C) | Electricity Passed (F) | [mmoles (current efficiency)] Unsubs | Monohalo | Dihalo | Selectivity to Mono[b] (%) |
|---|---|---|---|---|---|---|---|---|---|---|---|---|
| 7. | n-$C_4H_9OH$ | (4.00) | | HCl | (1.10) | 1.5 | 35–40 | 2.00 | trace | 276 (56) | 51 (15) | 84 |
| 8. | n-$C_4H_9OH$ | (4.00) | | HCl | (1.10) | 1.5 | 35–40 | 2.36 | trace | 289 (34) | 56 (10) | 84 |
| 9. | n-$C_4H_9OH$ | (4.00) | | HCl | (2.06) | 1.5 | 35–6 | 0.40 | trace | 76 (76) | 8 (12) | 90 |
| 10. | n-$C_4H_9OH$ | (4.00) | | HBr | (0.50) | 1.0 | 58–60 | 1.00 | trace | 57 (23) | 13 (8) | 81 |
| 11. | n-$C_4H_9OH$ | (4.00) | | HI | (0.50) | 1.0 | 58–60 | 1.00 | — | — | — | — |
| 12. | n-$C_4H_9OH$ | (1.00) | $CH_2Cl_2$[c] | HCl | (satd.) | 0.8 | 38–40 | 0.10 | trace | 20 (80) | 0.3 (2) | 99 |
| 13. | iso-$C_4H_9OH$ | (1.00) | $CH_3OH$[d] | HCl | (2.08) | 4.0 | 35–40 | 4.0 | nd[e] | 610 (61)[f] | — | — |
| 14.[g] | $CH_3OH$ | (8.00) | | HCl | (0.98) | 4.0 | 28 | 1.60 | 40 (5) | — | — | — |

[a]Apart from excess alcohol.
[b]Monosubstituted acetal as a percentage of all three (mole basis).
[c]200 ml.
[d]256 g. (8.0 moles).
[e]No attempt made to detect this compound.
[f]Product is 2-chloroisobutyraldehyde dimethyl acetal.
[g]Methyl formate, 19 mmoles (5 percent current efficiency), also formed.

The acetals of 2-haloacetals have a number of useful purposes. As noted hereinabove, such compounds are versatile bifunctional reagents which can react either as alkyl halides or as sources of an aldehyde, or both. They are particularly useful intermediates in the synthesis of sulfathiazole and substituted derivatives thereof. For example, the former compound, sulfathiazole—a well known sulfa drug, is readily prepared by reaction of chloroacetal (chloroacetaldehyde diethyl acetal) with p-acetamidobenzenesulfonylthiourea followed by alkaline hydrolysis of the resulting p-acetamidobenzenesulfonamidothiazole to remove the N-acetyl group.

While the invention has been described with respect to various specific examples and embodiments thereof, it is to be understood that the invention is not limited thereto and that many alternatives, modifications, and variations will be apparent to those skilled in the art in light of the foregoing description. Accordingly, it is intended to embrace all such alternatives, modifications, and variations as fall within the spirit and broad scope of the invention.

What is claimed is:

1. A process for the preparation of acetals of 2-haloaldehydes which comprises subjecting a substantially anhydrous liquid electrolysis medium comprising a primary alcohol having at least one beta hydrogen atom and an anhydrous hydrogen halide selected from the group consisting of hydrogen chloride and hydrogen bromide to electrolysis in an electrolytic cell to yield the acetal of the 2-haloaldehyde corresponding to the primary alcohol.

2. The process of claim 1 wherein the primary alcohol is ethanol.

3. The process of claim 1 wherein the primary alcohol is n-butyl alcohol.

4. The process of claim 1 wherein the primary alcohol is isobutyl alcohol.

5. The process of claim 1 wherein the primary alcohol is ethanol, the anhydrous hydrogen halide is hydrogen chloride, and the acetal of the 2-haloaldehyde is chloroacetaldehyde diethyl acetal.

6. The process of claim 1 wherein the primary alcohol is n-butyl alcohol, the anhydrous hydrogen halide is hydrogen chloride, and the acetal of the 2-haloaldehyde is 2-chloro-n-butyraldehyde di-n-butyl acetal.

7. The process of claim 1 wherein the primary alcohol is n-butyl alcohol, the anhydrous hydrogen halide is hydrogen bromide, and the acetal of the 2-haloaldehyde is 2-bromo-n-butyraldehyde di-n-butyl acetal.

8. The process of claim 1 wherein the molar ratio of anhydrous hydrogen halide to the primary alcohol is between about 1:0.1 and about 1:10.

9. The process of claim 1 wherein the reaction temperature is between about 0° C. and about 100° C.

10. The process of claim 1 wherein a graphite anode and a graphite cathode are used.

11. The process of claim 1 wherein the electrolytic cell is an undivided cell.

12. The process of claim 1 wherein the liquid electrolysis medium contains an added solvent.

13. The process of claim 12 wherein the added solvent is selected from the group consisting of methanol and methylene chloride.

14. A process for the preparation of dimethyl acetals of 2-haloaldehydes which comprises subjecting a substantially anhydrous liquid electrolysis medium comprising a primary alcohol having at least one beta hydrogen atom, anhydrous hydrogen halide selected from the group consisting of hydrogen chloride and hydrogen bromide, and methanol to electrolysis in an electrolytic cell to yield the dimethyl acetal of the 2-haloaldehyde corresponding to the primary alcohol.

15. The process of claim 14 wherein the concentration of the primary alcohol in methanol is between about 1.0 molar and about 6.0 molar; the molar ratio of the hydrogen halide to the primary alcohol is between about 1:0.1 and about 1:10, and the reaction temperature is between about 0° C. and about 100° C.

16. The process of claim 14 wherein the primary alcohol is isobutyl alcohol, the anhydrous hydrogen halide is hydrogen chloride, and the dimethyl acetal of the 2-haloaldehyde is 2-chloroisobutyraldehyde dimethyl acetal.

* * * * *